US006039058A

United States Patent [19]

Fujikawa et al.

[11] Patent Number: 6,039,058

[45] Date of Patent: Mar. 21, 2000

[54] DEVICE FOR AND METHOD OF CLEANING FILLING NOZZLE

[75] Inventors: Yasuji Fujikawa; Michio Ueda, both of Tokushima, Japan

[73] Assignee: Shikoku Kakoki Co., Ltd., Tokushima, Japan

[21] Appl. No.: 09/201,774

[22] Filed: Dec. 1, 1998

[30] Foreign Application Priority Data

Dec. 2, 1997 [JP] Japan ..... 9-331521

[51] Int. Cl.[7] ..... B08B 9/00

[52] U.S. Cl. ..... 134/104.1; 134/166 R; 141/90; 141/91

[58] Field of Search ..... 141/89, 90, 91; 134/104.1, 166 R, 169 R

[56] References Cited

U.S. PATENT DOCUMENTS

| | | | |
|---|---|---|---|
| 3,430,639 | 3/1969 | Roberts | 134/169 R X |
| 4,024,896 | 5/1977 | Ishioka et al. | 141/91 X |
| 4,213,795 | 7/1980 | Ernstsson et al. | 141/90 X |
| 4,559,961 | 12/1985 | Anderson et al. | 134/166 R X |
| 4,964,444 | 10/1990 | Hanerus et al. | 134/166 R X |
| 5,353,830 | 10/1994 | Mochizuki et al. | 141/91 X |
| 5,845,683 | 12/1998 | Sundby et al. | 141/90 |

FOREIGN PATENT DOCUMENTS

| | | |
|---|---|---|
| 0 351 872 A1 | 1/1990 | European Pat. Off. . |
| WO 95/33675 | 12/1995 | WIPO . |

*Primary Examiner*—Philip R. Coe

*Attorney, Agent, or Firm*—Armstrong, Westerman, Hattori, McLeland & Naughton

[57] ABSTRACT

A device for cleaning a filling nozzle comprises an adapter 32 having an upward socket 51 connectable to a downward discharge outlet 22 of the filling nozzle 21 and connected to a collecting pipe 31 to hold the socket 51 in communication with the collecting pipe 31, a cleaner 33 having a downward cleaning spout 81 connectable to the socket 51 and so disposed as to position the cleaning spout 81 at one side of the discharge outlet 22, and means for moving the adapter 32 so as to connect the socket 51 to the discharge outlet 22 and the cleaning spout 81 alternately.

6 Claims, 8 Drawing Sheets

DEVICE FOR AND METHOD OF CLEANING FILLING NOZZLE

BACKGROUND OF THE INVENTION

The present invention relates to a device for and a method of cleaning filling nozzles for use in apparatus for filling a beverage or like liquid into containers.

Such devices already known comprise an adapter which has an upward socket connectable to a downward discharge outlet of a filling nozzle and which is connected to a collecting pipe to hold the socket in communication with the collecting pipe. In cleaning the filling nozzle, the socket is manually connected to the discharge outlet to subsequently supply steam and/or a cleaning liquid to the filling nozzle.

It is cumbersome and inefficient to manually connect the socket to the discharge outlet. Moreover, in the case where the socket is held disconnected from the discharge outlet during filling, it is likely that the adapter itself will be contaminated with the surrounding atmosphere.

SUMMARY OF THE INVENTION

An object of the present invention is to provide a filling nozzle cleaning device which is adapted to automatically connect the socket of an adapter to the discharge outlet of a filling nozzle and which is free of the likelihood that the adapter will be contaminated during filling.

The present invention provides a device for cleaning a filling nozzle which device comprises an adapter having an upward socket connectable to a downward discharge outlet of the filling nozzle and connected to a collecting pipe to hold the socket in communication with the collecting pipe, a cleaner having a downward cleaning spout connectable to the socket and so disposed as to position the cleaning spout at one side of the discharge outlet, and means for moving the adapter so as to connect the socket to the discharge outlet and the cleaning spout alternately.

With the cleaning device of the present invention, the adapter socket is automatically connectable to the nozzle discharge outlet. When the adapter socket is connected to the cleaning spout of the cleaner in the case where the socket is held disconnected from the discharge outlet during filling, there is no likelihood that the adapter will be contaminated with the atmosphere around the device.

The filling nozzle has a downward annular seal face at an edge portion of the discharge outlet, and the cleaner has a downward annular seal face at an edge portion of the cleaning spout, the socket being provided on a peripheral wall thereof with a packing for permitting the seal faces of the filling nozzle and the cleaner to come into bearing contact therewith, the cleaner seal face having an inner periphery greater than an outer periphery of the nozzle seal face. The packing can then be held clean. More specifically, insofar as the adapter is in contact with the cleaner, the surface of the packing to be brought into contact with the nozzle seal face is unlikely to become contaminated with the atmosphere surrounding the device.

The moving means has a movable support member supporting the adapter so as to move the adapter on a line through the discharge outlet and the cleaning spout when seen from above and supported by a horizontal pin extending in a direction intersecting the direction of movement of the adapter so as to be pivotally movable upward and downward. The adapter is then movable smoothly.

When the adapter is movable by a first actuator, with the support member made pivotally movable by a second actuator, the adapter is slidable and movable upward or downward at desired timing.

If the support member is provided with a bracket advanced to below the path of movement of the adapter, and when the bracket is provided with a support movable into bearing contact with a lower surface of the adapter, the adapter can be pressed against the filling nozzle reliably.

When the support is movable toward and away from the adapter and is provided with means capable of fixing the support in a desired position, the level of the support is adjustable to adjust the pressure of the support.

Preferably, the collecting pipe has a flexible pipe over at least one portion of the entire length thereof.

For use in the cleaning device described, the present invention provides a method of cleaning the filling nozzle wherein a cleaning liquid is caused to flow out from the cleaner during the movement of the adapter before the adapter becomes connected to the cleaner after leaving the filling nozzle.

By this method, the packing can be cleaned not only over the portion thereof surrounded by the cleaner seal face in contact with the packing but also over the contact portion of the packing and the outside portion thereof.

DESCRIPTION OF THE PREFERRED EMBODIMENTS

Embodiments of the present invention will be described next with reference to the drawings.

Figure 1:
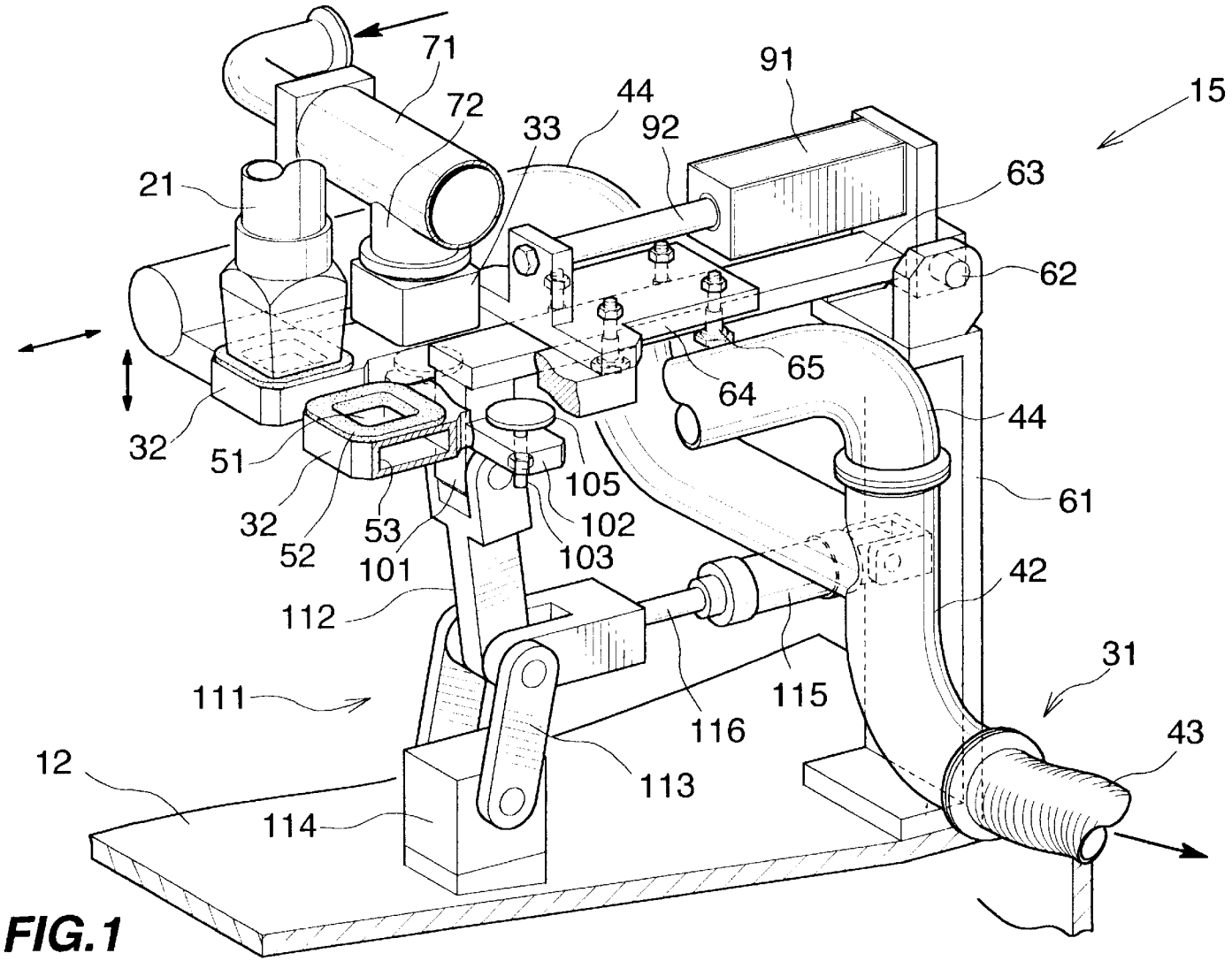
FIG. 1 is a perspective view of a cleaning device embodying the invention.

In the following description, the terms "front" and "rear" refer to one side of the plane of FIG. 1 toward the viewer perpendicular thereto and the other side of the plane, respectively, and the terms "left" and "right" refer respectively to the left-hand side and the right-hand side of FIG. 1.

Figure 2:
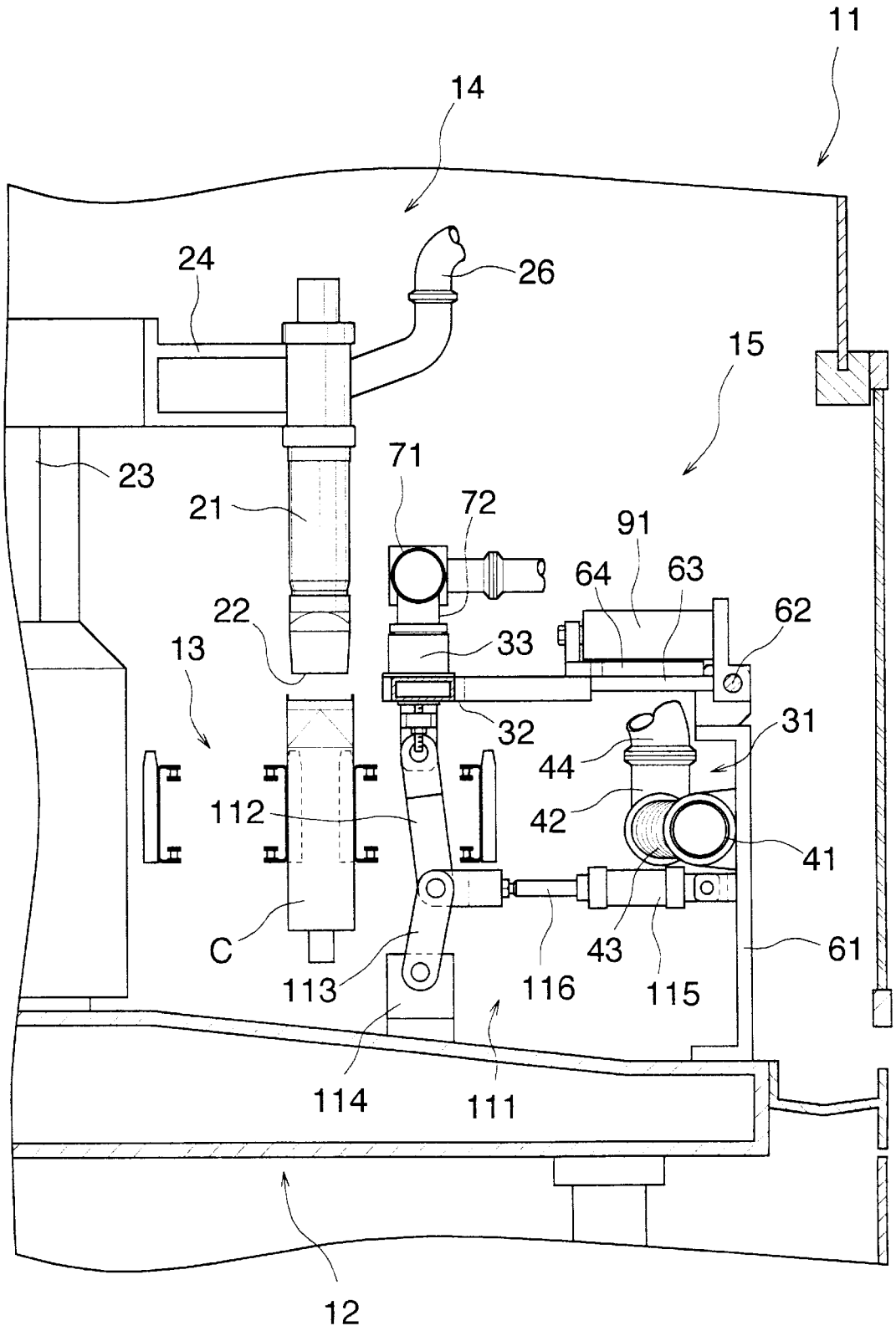
FIG. 2 is a front view of the cleaning device and the vicinity thereof.

FIG. 2 shows a container conveyor 13 having a transport path extending in the front-rear direction over a bed 12 inside a clean room 11, a filling apparatus 14 for filling contents into containers C which are being transported on the conveyor 13, and a device 15 for cleaning the filling apparatus 14.

Figure 7:
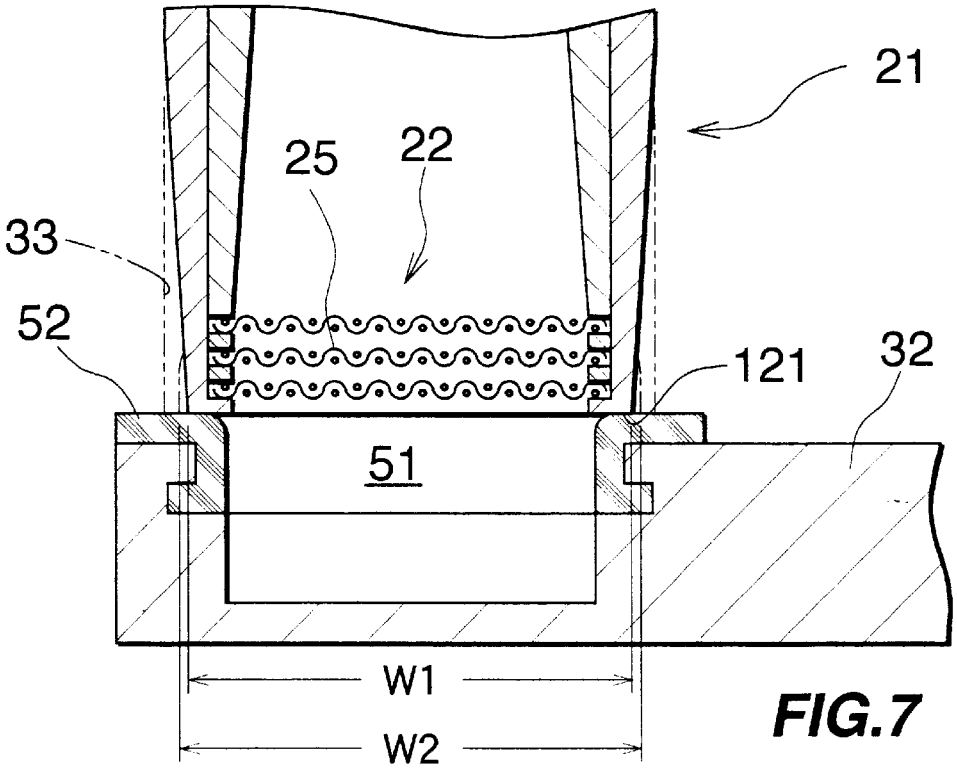
FIG. 7 is a diagram for illustrating an adapter as connected to a filling nozzle.

The filling apparatus 14 has front and rear two filling nozzles 21 arranged above the container transport path and spaced apart along the direction of transport by a distance equal to the distance the container is moved at a time during intermittent transport. Each of the filling nozzles 21 is in the form of a generally vertical hollow cylinder, has an approximately square discharge outlet 22 at its lower end and is supported by a bracket 24 on a stand 23 provided at the left side of the transport path. The discharge outlet 22 is provided with screens 25 for preventing the liquid to be filled from flowing out of the nozzle 21 downward under gravity (FIG. 7). An unillustrated metering cylinder is connected by a connection pipe 26 to an upper portion of the filling nozzle 21. The liquid to be filled is fed by the metering cylinder to the nozzle 21 in a specified quantity at a time. When required, at least one of sterilizing steam and a cleaning liquid is supplied to the filling nozzle 21.

The cleaning device 15 comprises a collecting pipe 31, front and rear two adapters 32 corresponding to the two filling nozzles 21 for connecting the nozzles 21 to the collecting pipe 31, and front and rear two cleaners 33 corresponding to these adapters 32 and arranged at the right of the respective nozzles 21.

The collecting pipe 31 comprises a fixed pipe 41, a movable pipe 42, and a flexible pipe 43 interconnecting these pipes 41, 42. The movable pipe 42 has front and rear branch pipes 44.

Each of the adaptors 32 is in the form of a strip extending laterally and has an upward socket 51 at its left end. A packing 52 made of elastic material and generally U-shaped in cross section is attached to the peripheral edge portion of the socket 51. The front adapter 32 is formed with a communication opening 53 facing toward the front, and the rear adapter 32 with a communication opening 53 facing rearward. These openings 53 are in communication with the front and rear branch pipes 44 in corresponding relation.

Figure 5:
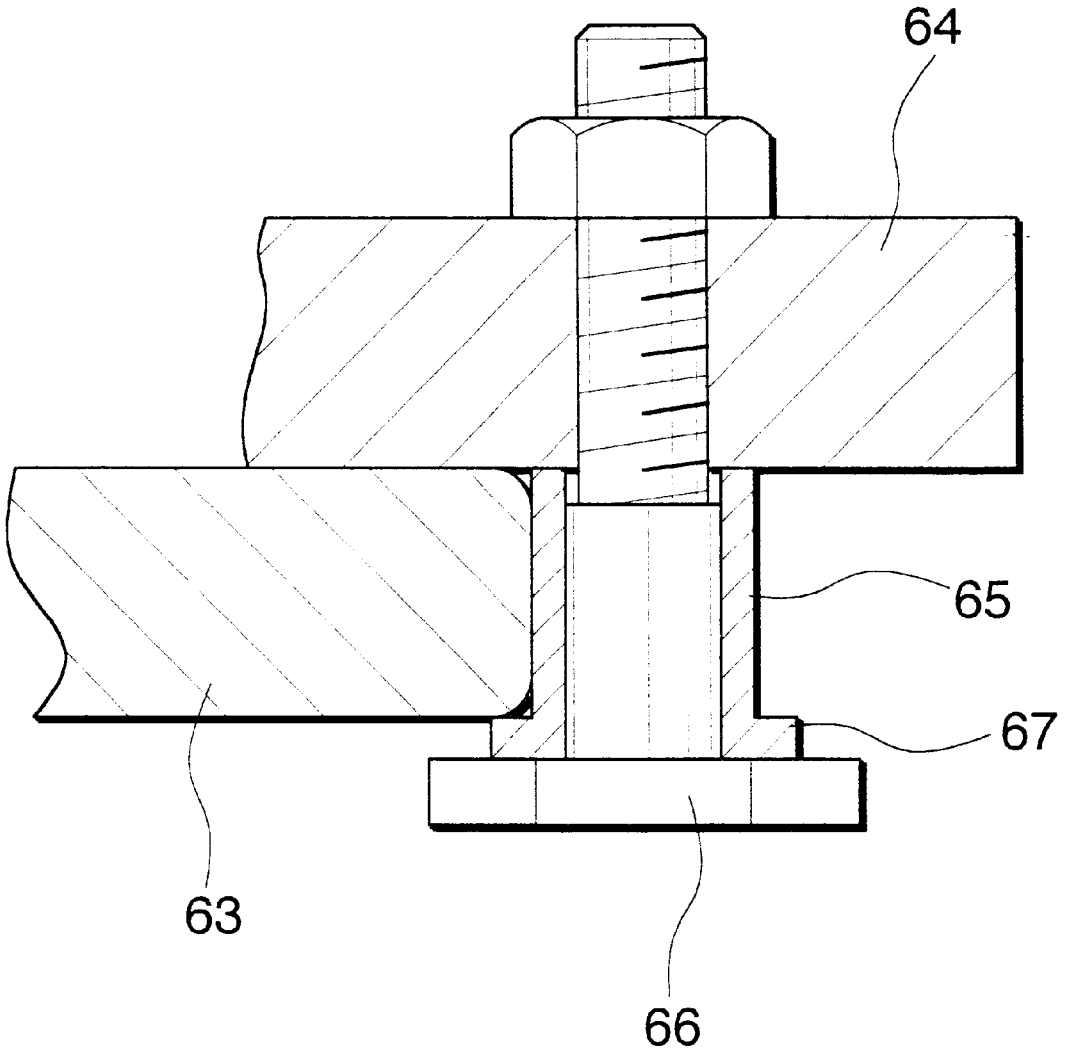
FIG. 5 is a view in section taken along the line V—V in FIG. 3.

Disposed at the right of the front and rear adapters 32 therebelow is a support bracket 61 in the form of a vertical plate and provided upright on the bed 12. A horizontal pin 62 extending longitudinally of the conveyor is disposed at the upper end of the support bracket 61. A striplike support plate 63 extending laterally is supported at its right end by the pin 62 pivotally movably upward and downward, and the left portion of the plate 63 is positioned between the adapters 32. A slide plate 64 is placed on the upper surface of the support plate 63. The two adapters 32 are interconnected by the left end portion of the slide plate 64. The slide plate 64 is provided at each of its front and rear sides with two guide rollers 65 as suspended therefrom. The support plate 63 is held at its opposite sides between the front and rear pairs of guide rollers. As shown in greater detail in FIG. 5, each guide roller 65 is in the form of a vertical sleeve fitted around a hanging bolt 66 and has at its lower end a flange 67 for supporting an edge portion of the support plate 63.

Figure 6:
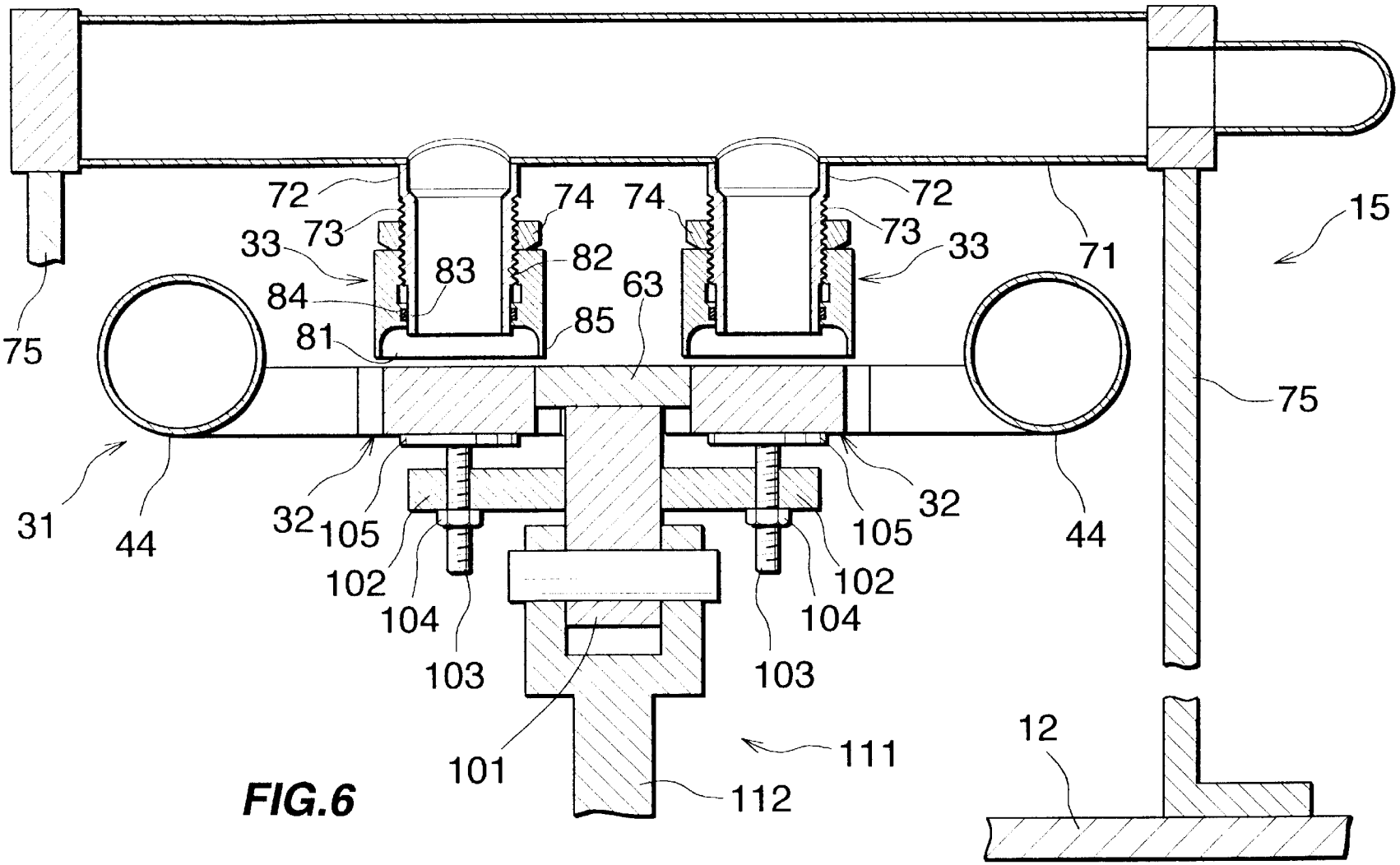
FIG. 6 is a view in section taken along the line VI—VI in FIG. 3.

A horizontal cleaning liquid pipe 71 extends longitudinally of the conveyor across the two cleaners 33 thereabove. With reference to FIG. 6, the peripheral wall of the pipe 71 is provided with front and rear two branch pipes 72 extending downward therefrom and corresponding to the two cleaners 33 respectively. The branch pipes 72 are each externally threaded as at 73. A lock nut 74 is screwed on the threaded portion 73. The cleaning liquid pipe 71 is supported by support members 75 on the bed 12.

The cleaner 33 is in the form of a vertical short hollow cylinder fitted around the branch pipe 72 and has a cleaning spout 81 at its lower end. The cleaning spout 81 is square similarly to the discharge outlet 22. The cleaner 33 is internally threaded as at 82 and screwed on the externally threaded portion 73, and is internally formed with an annular groove 84 positioned below the threaded portion 82 and having an o-ring 83 fitted therein. The cleaner 33 has a skirt 85 at its lower end.

The level of the cleaner 33 is adjustable by altering the screwed position of the cleaner 33 relative to the branch pipe 72.

A cleaning liquid is supplied to the pipe 71, or the supply is discontinued as desired. The cleaning liquid to be used is chlorine water having an ordinary temperature of 15 to 25 deg C. and a concentration of 70 to 100 ppm. The chlorine water may be replaced by an electrolytic strongly acid aqueous solution. To be suitable, the acid solution is up to 2.7 in pH and 50 ppm in chlorine ion concentration.

Mounted on the support plate 63 is a fluid pressure cylinder 91 as directed leftward for sliding the adapters. The cylinder 91 has a piston rod 92 connected to the slide plate 64.

With reference to FIG. 6, the support plate 63 has an ear 101 extending downward from the bottom of the left end portion thereof. The ear 101 is provided, at an intermediate portion of the height thereof, with wings 102 extending forward and rearward therefrom and advanced to below the respective adapters 32. A level adjusting bolt 103 extends through each of the front and rear wings 102 in screw-thread engagement therewith. A lock nut 104 is screwed on the bolt 103. The bolt 103 has a horizontal disklike support 105 integral with the bolt upper end and having an upper surface in bearing contact with the bottom of the adapter 32.

A toggle link mechanism 111 comprises an upper rod 112 connected at its upper end to the ear 101 in the vicinity of the lower end thereof, and a lower rod 113 connected at its lower end to a mount block 114 on the bed 12. A fluid pressure cylinder 115 for moving the adapters upward and downward is attached to the support bracket 61 approximately at the midportion of the height thereof and has a piston rod 116 connected to the connected ends of the upper and lower rods 112, 113.

Figure 3:
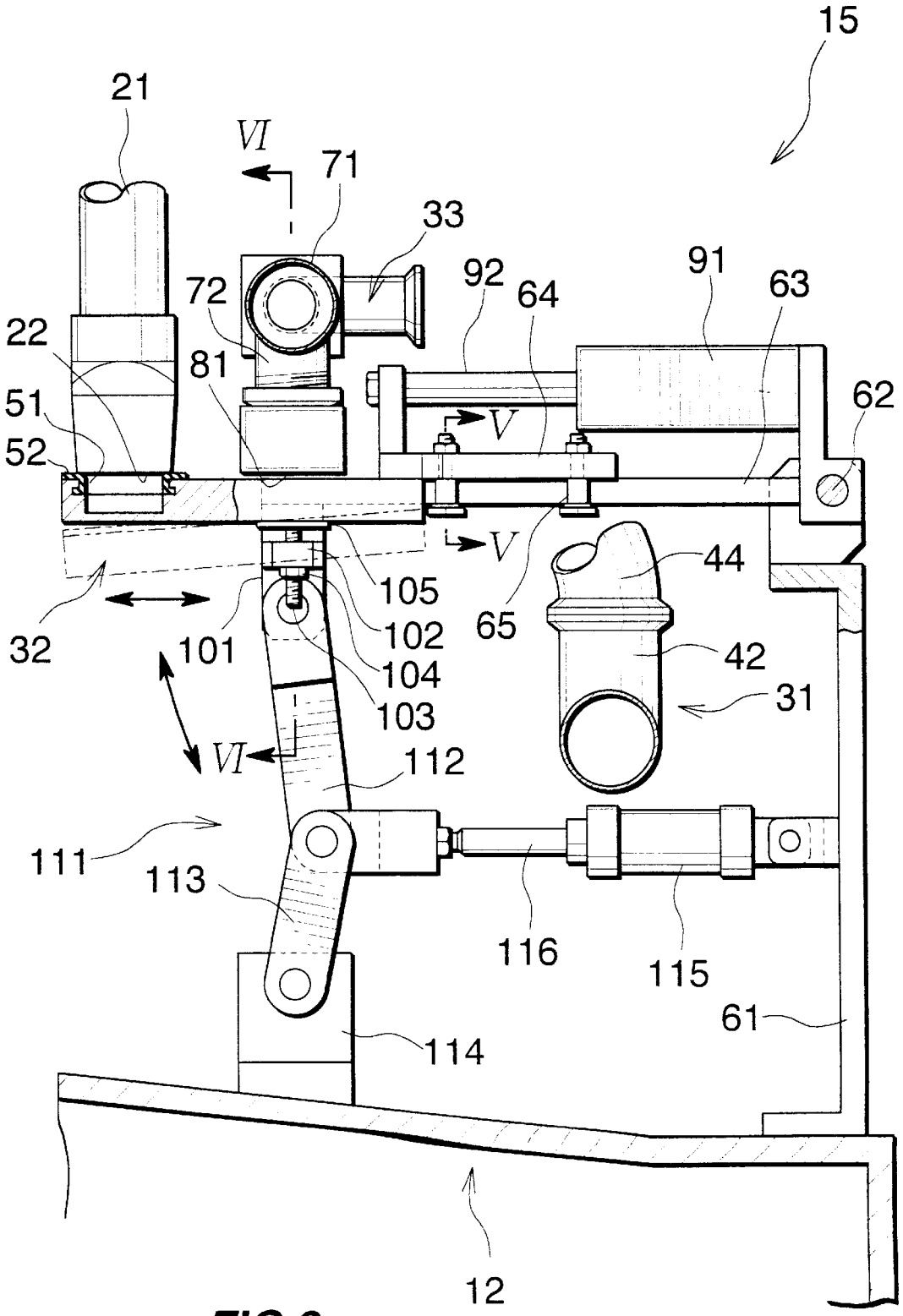
FIG. 3 is an enlarged fragmentary front view of FIG. 2.
Figure 4:
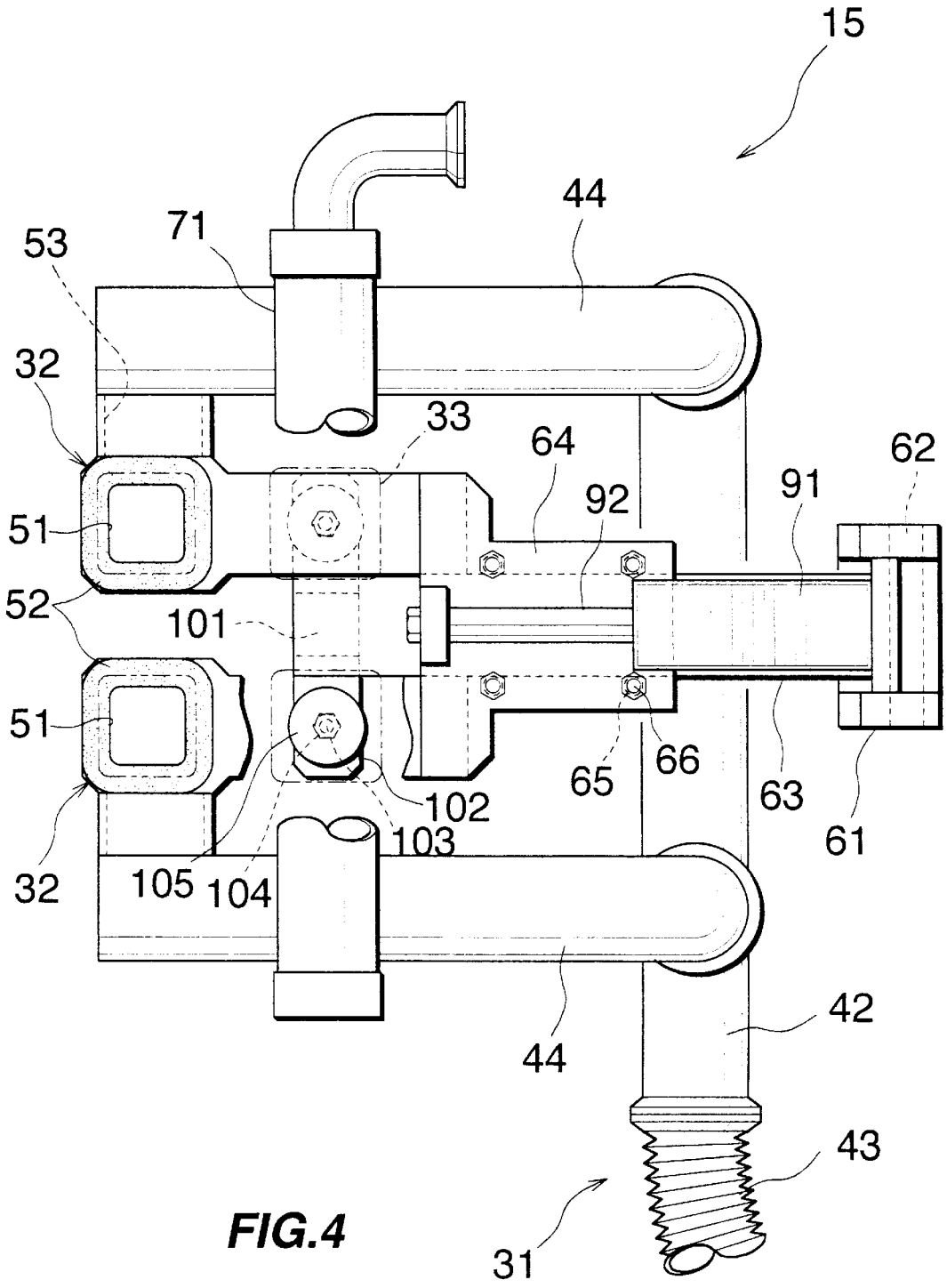
FIG. 4 is a plan view of the portion shown in FIG. 2.

FIG. 3 shows the adapter 32 as connected to the filling nozzle 21. The adapter 32 is in a horizontal position and has its socket edge portion pressed against the discharge outlet edge portion of the filling nozzle 21. In this state, the nozzle 21 is cleaned or sterilized by drawing off a remaining portion of the liquid to be filled or by supplying, for example, steam to the nozzle 21. The remaining liquid, steam or the like is collected through the collecting pipe 31.

When the toggle link mechanism 111 is collapsed from this state by retracting the piston rod 116 of the cylinder 115, the adapter 32 is brought to a leftwardly downwardly inclined position as indicated in a two-dot chain line in FIG. 3. The adapter 32 is moved rightward by retracting the piston rod 92 of the adapter sliding cylinder 91. When the adapter 32 is brought to below the cleaner 33, the piston rod 116 of the cylinder 115 is advanced to unfold the toggle link mechanism 111, whereby the adapter 32 is pivotally moved upward and has its socket edge portion pressed against the cleaning spout edge portion of the cleaner 33. The cleaning liquid is then supplied to the pipe 71 to clean the adapter 32. When the adapter 32 is completely cleaned, the supply of the cleaning liquid may be discontinued, whereas the adapter 32 is held connected to the cleaner 33 to prevent the contamination of the adapter 32 with the outside air. The adapter 32 can be connected to the filling nozzle 21 again by reversely following the above procedure although a detailed description will not be given.

Before the adapter 32 is connected to the cleaner 33 in the above procedure, the cleaning liquid may be supplied to the cleaner 33 so as to apply the cleaning liquid from the cleaner 33 to the socket edge portion of the adapter 32. The packing 32 is then cleaned in its entirety.

Figure 8:
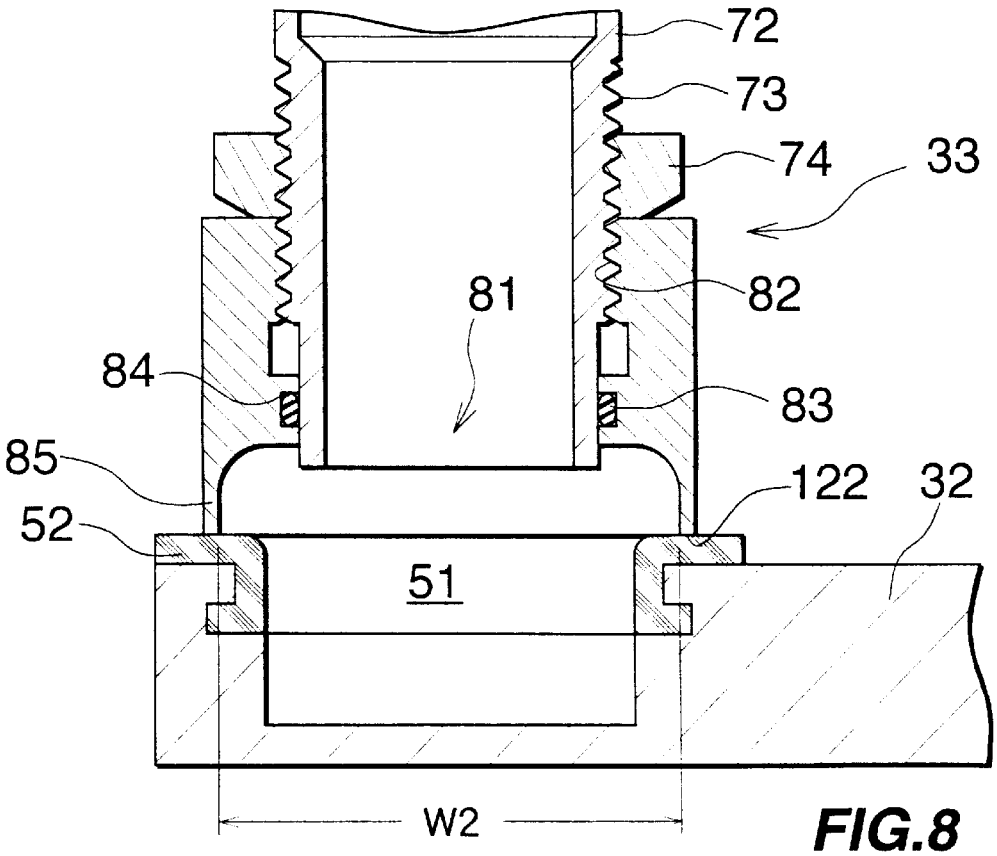
FIG. 8 is a diagram for illustrating the adapter as connected to a cleaner.

FIG. 7 shows the adapter 32 as connected to the filling nozzle 21, and FIG. 8 shows the adapter 32 as connected to the cleaner 33, these states being indicated in solid lines. FIG. 7 partly shows the cleaner 33 phantom lines.

The lower end face of the filling nozzle 21 and the lower end face of the cleaner 33 provide respective annular seal faces for contact with the packing 52. Suppose the distance between the opposed two sides of a square formed by the outer periphery of the seal face 121 of the nozzle 21 is W1, and the distance between the opposed two sides of a square formed by the inner periphery of the seal face 122 of the cleaner 33 is W2. Then W1<W2. This means that the portion of the packing 52 to be brought into contact with the nozzle seal face 121 can be surrounded by the contact portion of the cleaner seal face 122. Accordingly, insofar as the cleaner 33 is in contact with the adapter 32, it is unlikely that the portion of the packing 52 to be in contact with the nozzle seal face 121 will be contaminated with the outside air.

Figure 9:
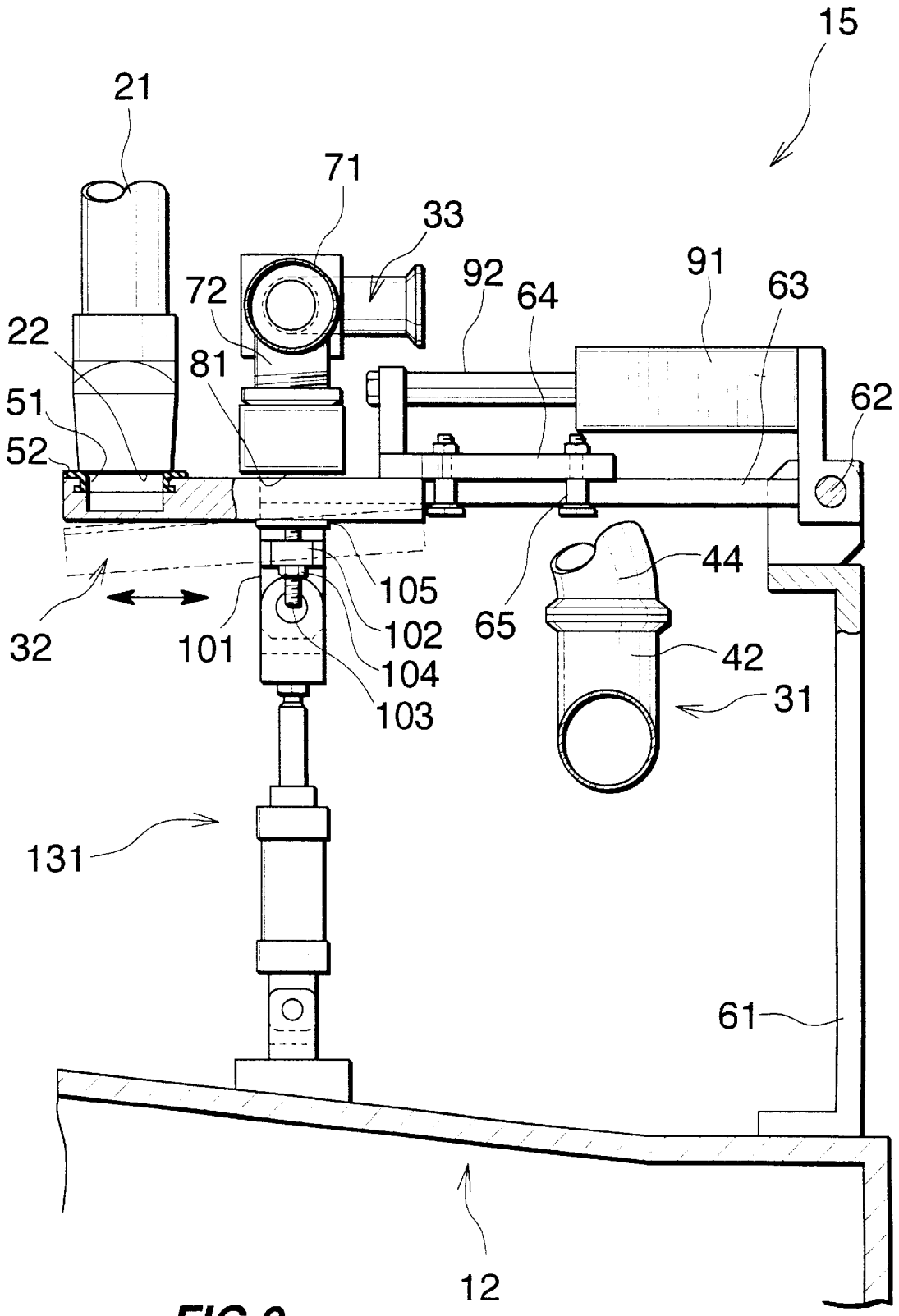
FIG. 9 is a front view corresponding to FIG. 3 and showing another embodiment.

FIG. 9 shows an embodiment wherein the support plate 63 is made pivotally movable directly by a fluid pressure cylinder 131 without using the toggle link mechanism.

What is claimed is:

1. A device for cleaning a filling nozzle which device comprises:

an adapter having an upward socket connectable to a downward discharge outlet of the filling nozzle and connected to a collecting pipe to hold the socket in communication with the collecting pipe, cleaner having a downward cleaning spout connectable to the socket and so disposed as to position the cleaning spout at one side of the discharge outlet, and means for moving the adapter so as to connect the socket to the discharge outlet and the cleaning spout alternately.

2. A filling nozzle cleaning device according to claim 1 wherein the filling nozzle has a downward annular seal face at an edge portion of the discharge outlet, and the cleaner has a downward annular seal face at an edge portion of the cleaning spout, the socket being provided on a peripheral wall thereof with a packing for permitting the seal faces of the filling nozzle and the cleaner to come into bearing contact therewith, the cleaner seal face having an inner periphery greater than an outer periphery of the nozzle seal face.

3. A filling nozzle cleaning device according to claim 1 or 2 wherein the moving means has a movable support member supporting the adapter so as to move the adapter on a line through the discharge outlet and the cleaning spout when seen from above and supported by a horizontal pin extending in a direction intersecting the direction of movement of the adapter so as to be pivotally movable upward and downward, the adapter being movable by a first actuator, the support member being pivotally movable by a second actuator.

4. A filling nozzle cleaning device according to claim 1 or 2 wherein the support member is provided with a bracket advanced to below the path of movement of the adapter, and the bracket is provided with a support movable into bearing contact with a lower surface of the adapter.

5. A filling nozzle cleaning device according to claim 4 wherein the support is movable toward and away from the adapter and is provided with means capable of fixing the support in a desired position.

6. A filling nozzle cleaning device according to claim 1 or 2 wherein the collecting pipe has a flexible pipe over at least one portion of the entire length thereof.

* * * * *